US007080418B2

(12) United States Patent
Henegar

(10) Patent No.: US 7,080,418 B2
(45) Date of Patent: Jul. 25, 2006

(54) INTEGRAL REFUSE DISPOSAL SYSTEM

(76) Inventor: Patricia H. W. Henegar, 1930 E. Medlock Dr., Phoenix, AZ (US) 85016

( * ) Notice: Subject to any disclaimer, the term of this patent is extended or adjusted under 35 U.S.C. 154(b) by 0 days.

(21) Appl. No.: 11/169,410

(22) Filed: Jun. 29, 2005

(65) Prior Publication Data

US 2005/0278843 A1 Dec. 22, 2005

Related U.S. Application Data

(63) Continuation-in-part of application No. 10/869,017, filed on Jun. 16, 2004, now Pat. No. 6,931,684.

(51) Int. Cl.
*A61G 7/02* (2006.01)
*A47K 11/06* (2006.01)
*B65B 9/10* (2006.01)

(52) U.S. Cl. ..... 5/86.1; 280/250.1; 4/480; 53/459; 53/567

(58) Field of Classification Search ..... 5/695, 5/604, 691, 86.1, 81.1 R, 653, 953, 655.9; 4/450–452, 456, 479, 483, 484, 480; 53/567, 53/576, 459; 280/250.1
See application file for complete search history.

(56) References Cited

U.S. PATENT DOCUMENTS

| | | | | |
|---|---|---|---|---|
| 1,054,452 | A | 2/1913 | Sayen | |
| 1,257,085 | A | 2/1918 | Mahoney | |
| 1,295,844 | A | 3/1919 | Bidwell | |
| 1,372,505 | A | 3/1921 | Handon | |
| 2,383,039 | A * | 8/1945 | Bushnell | 297/35 |
| 2,418,259 | A | 4/1947 | Harmanson | |
| 2,869,614 | A * | 1/1959 | Wamsley | 280/230 |
| 2,942,648 | A * | 6/1960 | Barsotti | 4/480 |
| 3,023,429 | A | 3/1962 | Borotra bom Chauvac | |
| 3,038,174 | A * | 6/1962 | Brown et al. | 5/611 |
| 3,061,368 | A * | 10/1962 | Matthews | 297/118 |
| 3,062,582 | A * | 11/1962 | Baldwin | 297/118 |
| 3,215,469 | A * | 11/1965 | Wamsley | 297/344.18 |
| 3,261,031 | A * | 7/1966 | Gates | 5/86.1 |
| 3,271,785 | A * | 9/1966 | Du Bose | 4/480 |
| 3,381,973 | A * | 5/1968 | Carr | 280/30 |
| 3,611,449 | A * | 10/1971 | Berry | 4/480 |
| 3,611,457 | A * | 10/1971 | Wippich | 4/480 |
| 3,757,355 | A | 9/1973 | Allen et al. | |
| 3,769,638 | A * | 11/1973 | Clanan | 4/237 |
| 3,849,811 | A | 11/1974 | Cyll | |
| 4,067,409 | A * | 1/1978 | DiMatteo et al. | 180/6.5 |
| 4,222,133 | A | 9/1980 | Csatary | |
| 4,266,305 | A * | 5/1981 | Kavaloski et al. | 4/480 |
| 4,296,506 | A * | 10/1981 | Stoute et al. | 4/480 |
| D278,779 | S * | 5/1985 | Sink | D6/596 |
| 4,592,562 | A * | 6/1986 | Strautnieks et al. | 280/250.1 |
| D286,626 | S * | 11/1986 | Britz | D12/128 |
| 4,654,904 | A * | 4/1987 | Britz | 297/411.26 |

(Continued)

*Primary Examiner*—Robert G. Santos
(74) *Attorney, Agent, or Firm*—Cahill, von Hellens & Glazer, P.L.C.

(57) ABSTRACT

A refuse disposal system is formed integrally with a wheelchair. A foam pad is positioned on a rigid seat of a wheelchair; the foam pad and rigid seat are each provided with openings in registration with each other. An annular cartridge of compressed disposable tubing is positioned within an annular well formed in the bottom surface of the foam pad. The disposable tubing extends from the annular cartridge upward over the flange of the pad and downward through the opening in the rigid seat.

5 Claims, 4 Drawing Sheets

U.S. PATENT DOCUMENTS 4,713,848 A * 12/1987 Domovs et al. ..... 4/480
4,869,049 A 9/1989 Richards et al.
4,934,529 A 6/1990 Richards et al.
4,949,408 A * 8/1990 Trkla ..... 5/86.1
5,056,293 A 10/1991 Richards et al.
5,564,136 A * 10/1996 Cox ..... 4/480
5,590,512 A 1/1997 Richards et al.
5,608,925 A * 3/1997 Porter ..... 4/480
6,176,508 B1 * 1/2001 Malassigne et al. ..... 280/648
D453,277 S 2/2002 Wilson
6,416,070 B1 * 7/2002 Lin ..... 280/250.1
6,418,571 B1 * 7/2002 Cheng ..... 4/480
6,539,558 B1 * 4/2003 Shero ..... 4/480
6,547,265 B1 * 4/2003 Enge et al. ..... 280/47.38
6,604,750 B1 * 8/2003 Malassigne et al. ..... 280/250.1
6,623,022 B1 * 9/2003 Malassigne et al. ..... 280/250.1
6,733,024 B1 * 5/2004 Savegnago ..... 280/250.1
6,804,930 B1 10/2004 Stravitz
6,851,251 B1 2/2005 Stravitz
6,901,974 B1 * 6/2005 Chomik et al. ..... 141/114
6,931,684 B1 * 8/2005 Henegar ..... 5/695
6,941,733 B1 * 9/2005 Chomik et al. ..... 53/576
6,974,029 B1 * 12/2005 Morand et al. ..... 206/303
6,976,278 B1 * 12/2005 Oetting et al. ..... 4/480
6,994,247 B1 * 2/2006 Richards ..... 232/43.1
2002/0024196 A1 * 2/2002 Malassigne et al. ..... 280/648
2002/0078665 A1 * 6/2002 Salman et al. ..... 53/459
2002/0170275 A1 * 11/2002 Salman et al. ..... 53/459
2003/0218022 A1 * 11/2003 Chomik et al. ..... 220/908
2004/0194433 A1 10/2004 Chomik et al.
2005/0028491 A1 2/2005 Stravitz
2005/0044819 A1 3/2005 Chomik et al.
2005/0126130 A1 * 6/2005 Stravitz ..... 53/567
2005/0183400 A1 * 8/2005 Stravitz et al. ..... 53/567
2005/0183401 A1 * 8/2005 Stravitz et al. ..... 53/567
2005/0188661 A1 * 9/2005 Stravitz et al. ..... 53/567
2005/0193691 A1 * 9/2005 Stravitz et al. ..... 53/567
2005/0193692 A1 * 9/2005 Stravitz et al. ..... 53/567
2005/0274093 A1 * 12/2005 Stravitz et al. ..... 53/567
2005/0278843 A1 * 12/2005 Henegar ..... 4/480
2006/0021301 A1 * 2/2006 Stravitz et al. ..... 53/576
2006/0037289 A1 * 2/2006 Chomik et al. ..... 53/459

* cited by examiner

INTEGRAL REFUSE DISPOSAL SYSTEM

CROSS-REFERENCE TO RELATED APPLICATION

This application is a continuation-in-part of an application entitled "BED HAVING AN INTEGRAL REFUSE DISPOSAL SYSTEM", filed Jun. 16, 2004 and assigned Ser. No. 10/869,017 now U.S. Pat. No. 6,931,684.

FIELD OF THE INVENTION

The present invention relates to integral refuse disposal systems that may be incorporated in wheel chairs or beds for use by incapacitated patients, and more particularly, facilities for accommodating sitting or reclining incontinent patients having a need for waste elimination without leaving the wheelchair or bed.

BACKGROUND OF THE INVENTION

Patients that are incontinent and confined to a bed or to a caretaker-driven wheelchair present obvious problems to nurses and other care givers. Many times, the patient cannot sufficiently control bodily functions to forewarn the attending care giver to provide assistance such as bedpans or other waste collection systems. The results are usually an embarrassment for the patient and the requirement for the expenditure of substantial time and effort on the part of the care giver to clean both the patient and the wheelchair or bed. Such events necessitate, at the least, changing the bedding, and perhaps even the mattress or the time consuming cleaning of the wheelchair structure. The time expended in such cleaning operations greatly increases the expense of the care facility and the cost to the patient. Further, the unpleasant cleaning task has demoralizing effects on the patient and makes it difficult for the care facility to retain competent care givers.

OBJECTS OF THE INVENTION

It is therefore an object of the present invention to provide an integral refuse disposal system incorporated in a bed or wheelchair.

It is also an object of the present invention to provide a waste disposal system for use by a bedridden or incapacitated patient.

It is a further object of the present invention to reduce the time and effort encountered by a care giver when cleaning after elimination by an incontinent patient.

It is still another object of the present invention to permit waste elimination of a bedridden or wheelchair bound patient with the least discomfort and embarrassment.

It is still another object of the present invention to provide a convenient and economical system for patient waste removal.

SUMMARY OF THE INVENTION

The present invention incorporates a bed or wheelchair, typically of the type found in hospitals and care facilities such as long term care organizations. The bed may be formed of two mattresses of foam material each having predetermined compression characteristics. The top mattress is constructed having a removable insert that incorporates an opening to receive a seat extending into the opening. A flexible, collapsible, plastic tubular member is positioned in the bottom of the removable insert and extends upwardly in the opening and surrounding the seat positioned in the opening. The plastic tubular member continues upwardly over the top of the seat and downwardly through the seat into the opening to extend to a position beneath the bed. The seat is positioned to register with the patient such that elimination by the patient will cause the resulting waste material to drop through the seat and into the tubular material. The wheelchair is formed with a rigid seat having a centralized opening and is provided with a fastening means such as a hook and eye tape similar to commercially available fastening tape known as Velcro®. A foam pad is provided with corresponding fastening tape and also having a centralized opening registering with the opening in the rigid seat. A similar flexible collapsible plastic tubular member is positioned on the bottom of the removable foam pad in a manner similar to that described above with regard to the bed. The foam pad is positioned to provide registration between the opening therethrough and the opening in the rigid seat such that elimination by the patient will cause resulting waste material to drop through the seat and into the tubular material.

BRIEF DESCRIPTION OF THE DRAWINGS

The present invention may more readily be disclosed by reference to the accompanying drawings in which.

DESCRIPTION OF THE ILLUSTRATED EMBODIMENT

Figure 1:
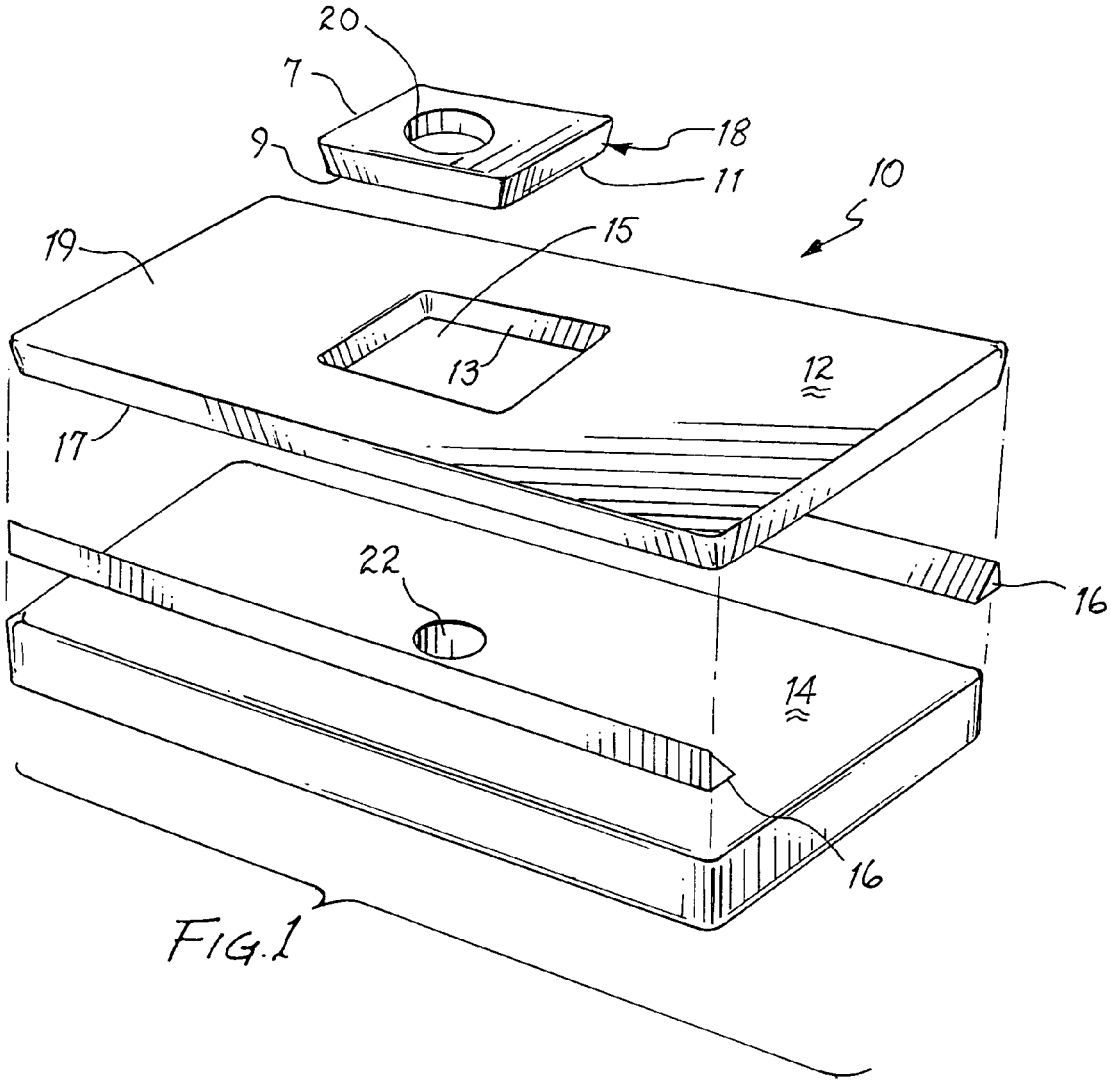
FIG. 1 is an exploded perspective view of a mattress suitable for use in the system of the present invention.

Referring now to FIG. 1, a mattress 10 is shown comprising an upper mattress pad 12 and a lower mattress pad 14. The use of dual pads in hospital mattresses has become common, and permits the selection of compression characteristics to suit patient comfort while providing the most economical mattress combination for the hospital or care facility. Typically, the upper mattress may be chosen for patient comfort and constructed of a modern viscoelastic foam material, while the lower mattress may be selected from a firmer material selected from a suitable polyurethane expanded foam. Edge reinforcement members 16 are positioned to add strength and necessary longitudinal rigidity to the structure.

In the embodiment chosen for illustration in FIG. 1, a removable mattress insert 18 is provided. An opening 20 is positioned in the insert to receive a seat to be described herein. The insert 18 and the included opening 20 are positioned relative to the mattress 12 to be in registration with a patient reclining on the mattress to permit any waste material from the patient to pass through the seat and the opening. A second opening 22 is formed in the lower mattress 14 and is positioned in registration with the first opening 20. The second opening 22 has a slightly smaller diameter than the opening 20 for reasons that will become apparent as the description proceeds. The edges 11 of the insert 18 are tapered to correspond to matching tapered edges 13 of the opening 15 provided in the mattress 12. This tapering assists the positioning of the insert in the mating opening provided in the mattress. When the insert 18 is positioned in the opening 15, the top and bottom surfaces 7 and 9 are coplanar with the top and bottom surfaces 19 and 17 of the mattress 12 respectively.

Figure 2:
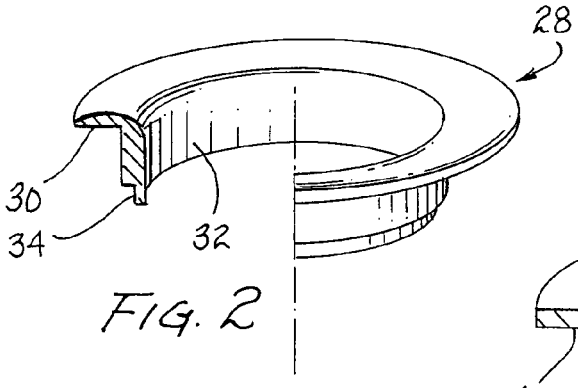
FIG. 2 is a perspective view of a refuse receiving seat for use in the system of the present invention.

Referring to FIG. 2, a perspective view, partly in section, of a seat for use in the invention is shown. The seat 28 includes a horizontally extending flange 30, a vertically extending body 32 and an annular notch 34. The seat 28 is positioned in the opening 20 of the mattress insert 18 or the foam pad 75 and adjacent the top surface 7 of the mattress insert or top surface 83 of the pad 75 as will be described. The seat may be formed of a suitable "skinned" foam material that is soft to the touch but sufficiently rigid to retain its shape.

Figure 3:
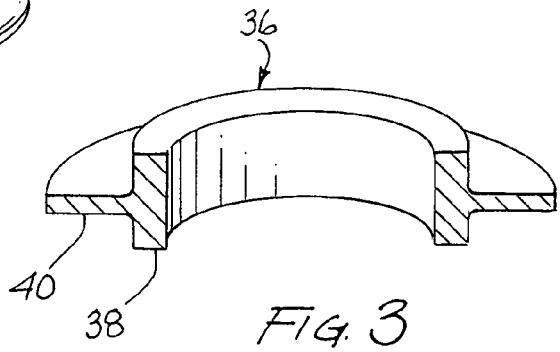
FIG. 3 is a perspective view, partly in section, of a capture ring for use in the system of the present invention.

FIG. 3 is a perspective view, partly in section, of a capture ring to be molded adjacent to the bottom surface of the mattress insert or foam pad 75 in a manner to be described. The capture ring 36 includes a cylindrical ring body 38 axially aligned with the opening or hole 20 or opening 77 and an integral radially extending annular flange 40. The capture ring may be formed of rigid plastic material and is intended to position and hold a supply of tubular plastic material as will be described herein.

Figure 4:
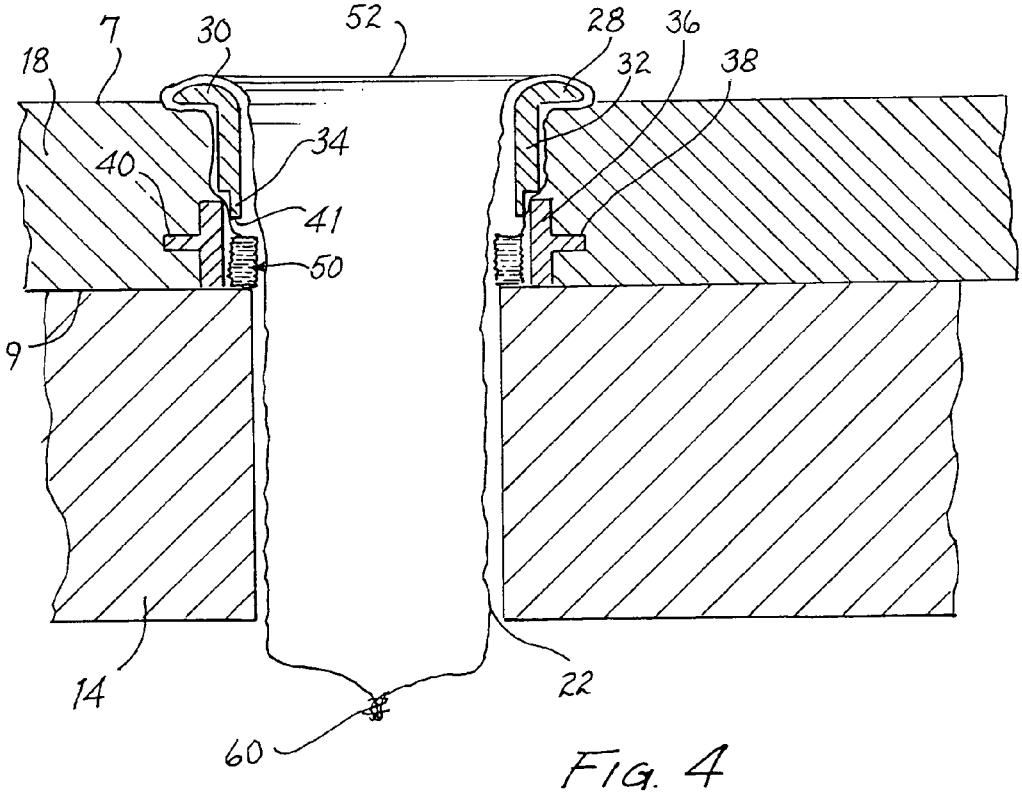
FIG. 4 is a cross-sectional view of a refuse disposal system constructed in accordance with the teachings of the present invention.

Referring to FIG. 4, a cross section of refuse disposal system constructed in accordance with the teachings of the present invention is shown. The lower mattress 14 is shown with the mattress insert 18 in place. The seat 28 is positioned in the hole 20 with the flange 30 resting on the upper surface 7 of the insert 18. The flange 30 may be flattened to make it less intrusive to the body of the patient. That is, the material and shape of the flange may be formed to render the texture and contour as "mattress-like" as possible to make the juncture of the seat and mattress "seamless" and thus more comfortable to the patient. The body 32 of the seat extends into the hole 20 with the notch 34 nesting in the ring body 38 of the capture ring 36. The capture ring 36 is molded into the removable mattress insert 18 with the ring body 38 terminating flush with the lower surface 19 of the mattress insert. The radially extending annular flange 40 of the capture ring 36 locks the ring in position and thus forms an annular well 41 receptacle to receive and hold an annular cartridge 50.

Figure 5:
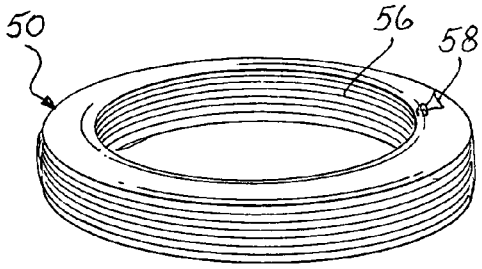
FIG. 5 is a perspective view of a suitable cartridge of plastic tubing material for use in the system of FIG. 4.
Figure 6:
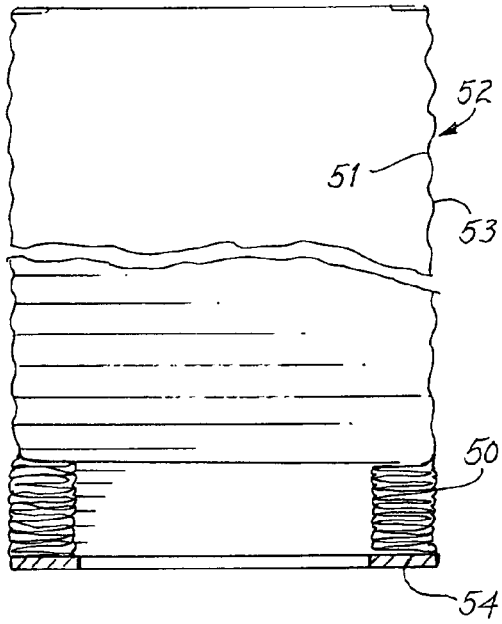
FIG. 6 is a cross-sectional view, partly exploded, of the cartridge of FIG. 5 and useful in the refuse disposal system of the present invention.

Referring to FIGS. 5 and 6, an annular cartridge is shown for use in the disposal system of the present invention. The cartridge comprises an elongated tubular flexible plastic member 52 that is folded and compressed into a tight ring-shaped or toroid-shaped package. The bottom of the tubular member may be attached to a disposable ring 54 that may be made of cardboard or the like, and enclosed in a suitable wrapping material 56 such as paper. The toroid shaped package may be opened using a "draw string" 58 in a well known manner, and the opened package inserted into the capture ring 36 that has been exposed at the bottom of the mattress insert 18. The tubular flexible member 52 is formed with two plies or opposing surfaces that have received different treatment. The outer surface 53 is intended to come into contact with the patient and therefore is formed of a soft paper or fabric layer or is fiber flocked. This surface should be pleasant to the touch and preferably moisture absorbent. The inner surface or layer 51 is a smooth plastic surface and contacts the seat 28 and must exhibit low contact sliding friction to facilitate the feeding of fresh material when the tubular material is advanced by the care giver.

In use, and prior to the patient occupying the bed, the attendant or care giver removes the seat 28 and the upper mattress insert 18 to expose the bottom surface 17 of the insert 18 and the bottom of the capture ring 36. An annular cartridge is selected and the package opened to expose the tubular member within. The package is placed in the annular well 41 as shown in FIG. 4, and the tubular member is then withdrawn from the package and extended upwardly out the opening 20 in the insert. The seat 28 is then replaced with the flexible tubular member extending around the outside of the seat and then downwardly through the seat to below the removable mattress insert 18. The insert is then replaced, and the flexible plastic tubular member is "threaded" through the hole 22 in the bottom mattress 14. The tubular member thus extends to below the bed and is tied or clamped as schematically indicated at 60 in any convenient manner to render the member leak proof. The tubular member is locked in position by the nesting of the annular notch 34 of the seat 28 within the ring body 38 of the capture ring 36.

The patient may then be placed on the bed and positioned to register with the seat. When elimination occurs, the refuse exits through the seat and downwardly through the upper and lower mattresses into the closed tubular member located beneath the bed. The patient may be repositioned to relieve the pressure on the seat and permit the care giver to pull fresh tubular material from the material cartridge 50 by pulling on the material from beneath the bed until fresh material appears. The flexible plastic tubular material may then be tied off beneath the bed with the refuse contained therein. The tubular member is then sealed or tied as in the beginning and the system is immediately available for the next occurrence.

Figure 7:
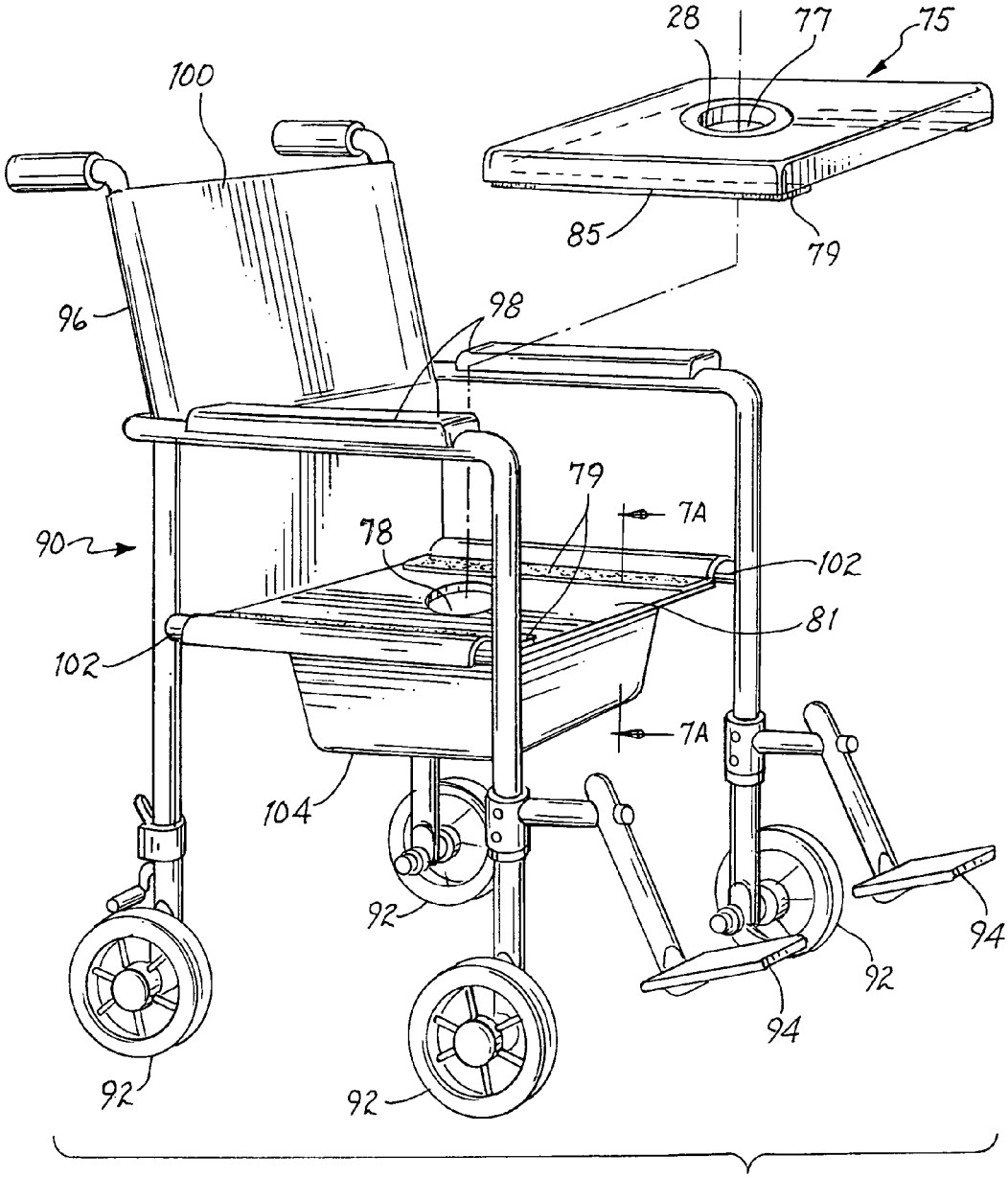
FIG. 7 is a perspective view of a refuse disposal system integrated with a wheelchair.
Figure 7A:
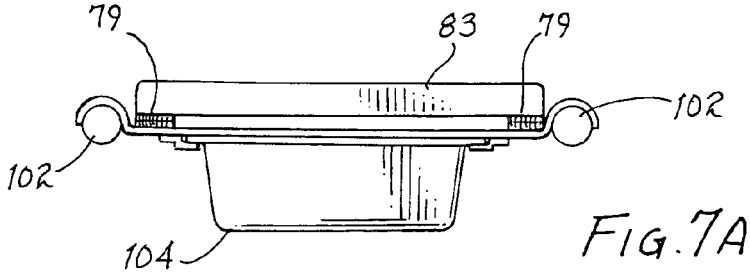
FIG. 7A is a front elevational view of a portion of FIG. 7 useful in the description of the invention.

Referring now to FIGS. 7 and 7A, an embodiment of the integral refuse disposal system of the present invention is shown formed integrally with a wheelchair. The wheelchair 90 is provided with wheels 92 and footrests 94 in a conventional manner. A framework 96 forms support for the back 100 and armrests 98. Longitudinal frame members 102 of the framework provide a means for supporting the removable rigid seat 81.

A removable foam pad 75 may be made from suitable foam material to provide firm but comfortable support for the patient. An opening 77 is formed in the pad 75 while hook and loop fastener strips 79 are attached to the foam pad 75 and corresponding strips are attached to the rigid seat 81. The fastener strips may be formed of typical hook and loop fastener strips such as that known as Velcro® to permit firm attachment of the foam pad when in its operative position but permit ready removal of the foam pad when desired. The top surface of the foam pad 83 and the lower surface 85 of the foam pad provide a means for positioning and registering the seat 28 as will be described more fully hereinafter. The opening 77 in the foam pad 75, when the pad is in its operative position on the rigid seat 81 is in registration with an opening 78 provided in the rigid seat 81. The rigid seat 81 is removable and may be supported within the wheelchair by resting upon longitudinal frame members 102 positioned on either side of the rigid seat, or alternatively may be removably mounted in any convenient manner. A modesty bag cover 104 is secured beneath the removable rigid seat in any convenient manner and is positioned beneath the opening 78. The cover 104 conceals the tubular flexible plastic member 52 (FIG. 8) as it extends beneath the rigid seat to conceal that portion of the tubular flexible member below the rigid seat and any waste that may be contained therein.

Figure 9:
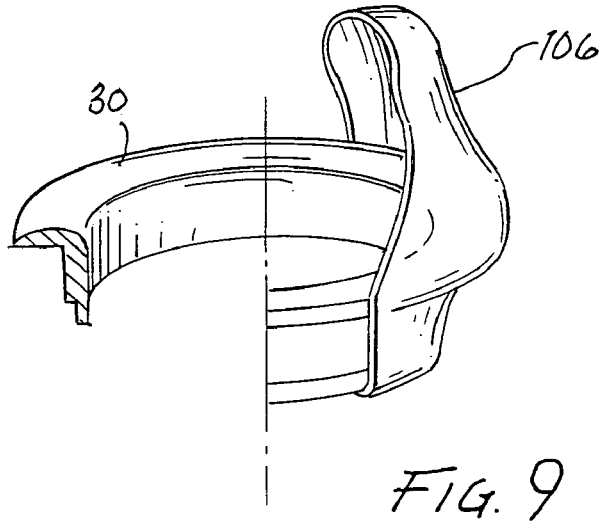
FIG. 9 is a perspective view of a shield that may be added to the refuse disposal system of FIG. 4.

For male patients, a shield 106 such as shown in FIG. 9 may be inserted between the removable foam pad and the flange 30. The shield may be placed as shown before or after positioning the patient on the foam pad, and may readily be removed without interfering with the operation of the system.

Figure 8:
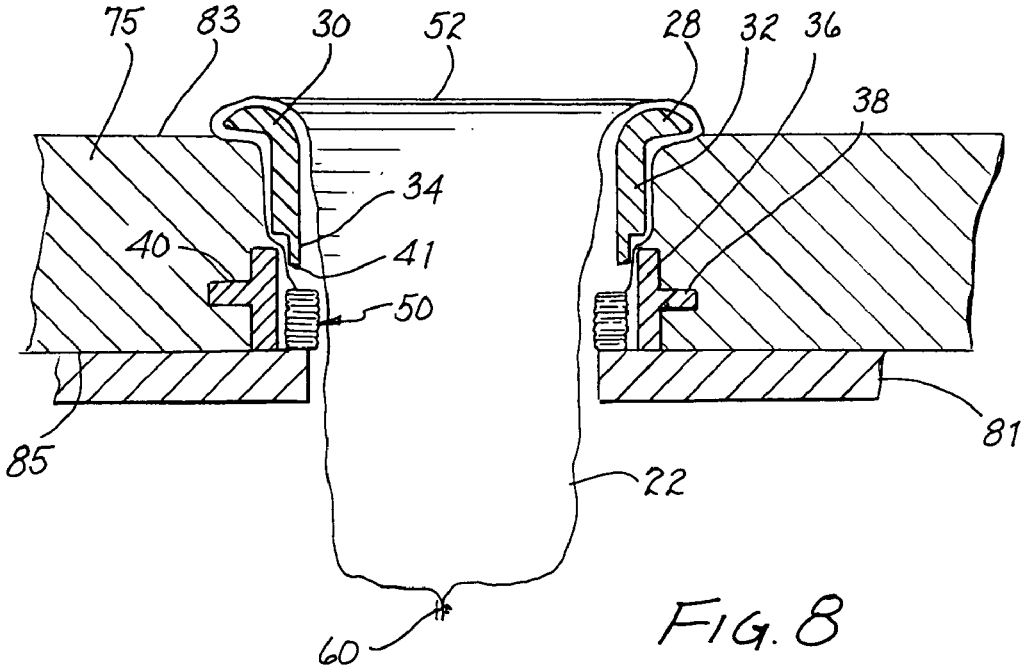
FIG. 8 is a cross-sectional view of a refuse disposal system constructed in accordance with the teachings of the present invention formed integral with a wheelchair.

Referring to FIG. 8, a cross section of refuse disposal system constructed in accordance with the teachings of the present invention is shown. The removable rigid seat 81 is shown with the foam pad 75 in place. The seat 28 is positioned in the hole 77 with the flange 30 resting on the upper surface 83 of the pad. The flange 30 may be flattened to make it less intrusive to the body of the patient. That is, the material and shape of the flange may be formed to render the texture and contour as "pad-like" as possible to make the juncture of the seat and pad "seamless" and thus more comfortable to the patient. The body 32 of the seat extends into the hole 77 with the notch 34 nesting in the ring body 38 of the capture ring 36. The capture ring 36 is molded into the removable pad 75 with the ring body 38 terminating flush with the lower surface 85 of the pad. The radially extending annular flange 40 of the capture ring 36 locks the ring in position and thus forms an annular well 41 receptacle to receive and hold an annular cartridge 50.

The operation of the embodiment of FIGS. 7, 7A, 8 and 9 is similar to that described in connection with the embodiment incorporating a bed. That is, the patient is placed on the pad and oriented appropriately over the opening extending through the pad and the rigid seat. The tubular member extends through the holes in the pad and rigid seat into the modesty bag cover 104. The tubular member is tied or clamped at its open end within the modesty bag cover to thereby retain waste material that may be deposited by the patient.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. An integral refuse disposal system comprising:

(a) a wheelchair having a rigid seat with an opening therein;

(b) removable foam pad having a top surface and a bottom surface and an opening extending therethrough, the opening positioned in registration with the opening in said rigid seat;

(c) a seat member extending into the opening in said pad and positioned adjacent the top surface of said pad and having a flange resting on said top surface;

(d) an annular well formed in said pad surrounding the opening in said pad;

(e) an annular cartridge of compressed disposable tubing positioned within said annular well; and (f) said disposable tubing extending upwardly from said cartridge over said seat member and downwardly through the openings in said pad and rigid seat.

2. The integral refuse disposal system set forth in claim 1 wherein said annular well is formed in the bottom surface of said removable foam pad surrounding said opening in said pad.

3. The integral refuse disposal system set forth in claim 1 wherein said annular well is formed by a capture ring having a cylindrical body mounted in said pad and aligned with the opening in said pad.

4. The integral refuse disposal system set forth in claim 1 wherein said disposable tubing has a smooth plastic inner surface and a soft moisture absorbent outer surface.

5. The integral refuse disposal system set forth in claim 1 wherein said disposable tubing has a smooth plastic inner surface and a fiber flocked outer surface.

* * * * *